US006270329B1

(12) United States Patent
Oshima et al.

(10) Patent No.: US 6,270,329 B1
(45) Date of Patent: Aug. 7, 2001

(54) ROTARY COMPRESSOR

(75) Inventors: Kenichi Oshima, Shimotsuga-gun; Minoru Ooki, Oyama; Shigeya Kawaminami; Tatuya Wakana, both of Shimotsuga-gun, all of (JP)

(73) Assignee: Hiatchi, Ltd., Tokyo (JP)

( * ) Notice: Subject to any disclaimer, the term of this patent is extended or adjusted under 35 U.S.C. 154(b) by 0 days.

(21) Appl. No.: 09/398,781

(22) Filed: Sep. 20, 1999

(30) Foreign Application Priority Data

Jun. 11, 1999 (JP) ..... 11-164757

(51) Int. Cl.[7] ..... F03C 2/00

(52) U.S. Cl. ..... 418/63; 418/64; 418/65; 418/66; 418/67

(58) Field of Search ..... 418/63, 64, 65, 418/66, 67

(56) References Cited

U.S. PATENT DOCUMENTS

| | | | | |
|---|---|---|---|---|
| 2,612,311 | * | 9/1952 | Warrick et al. | 418/63 |
| 4,629,403 | * | 12/1986 | Wood | 418/63 |
| 4,737,088 | * | 4/1988 | Taniguchi et al. | 418/63 |
| 4,975,031 | * | 12/1990 | Bagepalli et al. | 418/63 |
| 5,074,761 | * | 12/1991 | Hirooka et al. | 418/15 |
| 5,302,095 | * | 4/1994 | Richardson, Jr. | 418/63 |

FOREIGN PATENT DOCUMENTS

| | | | | |
|---|---|---|---|---|
| 60-32585 | | 3/1985 | (JP) . | |
| 62-11200 | | 3/1987 | (JP) . | |
| 63-230980 | * | 9/1988 | (JP) | 418/63 |
| 2-153288 | * | 6/1990 | (JP) | 418/63 |
| 2-308997 | * | 12/1990 | (JP) | 418/63 |
| 7229654 | | 8/1995 | (JP) . | |
| 7269483 | | 10/1995 | (JP) . | |

* cited by examiner

*Primary Examiner*—Thomas Denion
*Assistant Examiner*—Theresa Trieu
(74) *Attorney, Agent, or Firm*—Antonelli, Terry, Stout & Kraus, LLP

(57) ABSTRACT

A rotary compressor is provided with a cylinder which defines a cylinder chamber and a piston disposed in the cylinder chamber. The piston includes a roller which performs a revolving motion within the cylinder chamber and a vane which partitions the interior of the cylinder chamber into a suction chamber and a compression chamber. A small space is provided so as to communicate with the compression chamber in only a predetermined section without communicating with the suction chamber so as to suppress noise generated by a pressure fluctuation in the interior of a compression chamber and, at the same time, can prevent the occurrence of a loss induced by re-expansion of a refrigerant remaining in a small space and a loss induced by return of the refrigerant to a suction chamber.

32 Claims, 12 Drawing Sheets

ROTARY COMPRESSOR

BACKGROUND OF THE INVENTION

1. Field of the Invention

The present invention relates to a rotary compressor and more particularly to a rotary compressor suitable for use in air conditioners and refrigerator and refrigerating machines.

2. Description of the Related Art

As a conventional rotary compressor, reference is here made to one disclosed in Japanese Examined Patent Publication No. Sho 62-11200, which comprises a cylinder, a piston disposed within the cylinder, and a drive shaft for driving the piston, and wherein a small-volume space is brought into communication with a vicinity of a discharge port through a pressure introducing passage for the purpose of reducing noise induced by a pressure fluctuation which occurs within the cylinder (related art 1).

A conventional rotary compressor is also disclosed in Japanese Unexamined Patent Publication No. Sho 63-290980, which comprises a cylinder, a roller disposed within the cylinder, and a shaft for driving the roller, and wherein a small hole is formed in the vicinity of a discharge port in a cylinder end face so as to be partially open to a discharge recess (related art 2).

A further conventional rotary compressor is disclosed in Japanese Unexamined Utility Model Publication No. Sho 60-32585, which comprises a cylinder, a roller disposed within the cylinder, and a rotary shaft for driving the roller, and wherein a space is formed in communication with the interior of the cylinder with a view to reducing noise caused by a pressure fluctuation in the cylinder and an inlet passage which provides communication between the space and the interior of the cylinder is open to the interior of the cylinder at an intermediate pressure portion in order to prevent an increase of input caused by a reverse flow of a compressed refrigerant in the space at an initial stage of the compression stroke (related art 3).

In the above related arts 1 and 2, however, since the small-volume space or the small hole is always kept in communication with a compression chamber in the cylinder, a high-pressure refrigerant at the end of the discharge stroke, which remains in the small-volume space or in the small hole, flows reverse into the cylinder at the initial stage of the compression stroke, with consequent re-expansion and eventual loss.

In the above related art 3, since a space for diminishing the pressure fluctuation is open into the cylinder which is in the suction stroke, so that the refrigerant which remains within the space flows back into the cylinder during the suction stroke, thus giving rise to a loss.

SUMMARY OF THE INVENTION

It is an object of the present invention to provide a rotary compressor capable of reducing noise generated by a pressure fluctuation in a compression chamber and capable of preventing a loss caused by re-expansion of a refrigerant which remains in the small space and a loss caused by return of the refrigerant into a suction chamber.

According to the first feature of the present invention for achieving the above-mentioned object there is provided a rotary compressor comprising a cylinder which defines a cylinder chamber, a piston disposed within the cylinder chamber, and a drive mechanism for driving the piston, the piston having a roller which performs a revolving motion within the cylinder chamber and a vane which, together with the roller, partitions the interior of the cylinder chamber into a suction chamber and a compression chamber, with a small space being provided so as to communicate with the compression chamber in a predetermined section without coming into communication with the suction chamber.

According to the second feature of the present invention there is provided a rotary compressor comprising a cylinder which defines a cylinder chamber, a piston disposed within the cylinder chamber, and a drive mechanism for driving the piston, the piston having a roller which performs a revolving motion within the cylinder chamber and a vane which, together with the roller, partitions the interior of the cylinder chamber into a suction chamber and a compression chamber, with a small space being provided so as to communicate with the compression chamber in a predetermined section exclusive of a rotational angle of the roller corresponding to a minimum projection quantity of the vane into the cylinder chamber.

Preferably, the roller and the vane are formed integrally with each other, and the vane is supported by a swing bush so that it can swing, advance and retreat.

Preferably, a communication passage for communication of the small space with the compression chamber is formed in the swing bush.

Preferably, the roller and the vane are formed separately from each other.

Preferably, the communication passage for communication of the small space with the compression chamber is formed in the vane.

Preferably, the communication passage for communication of the small space with the compression chamber is constituted of a combination of a communication passage formed in the vane and a communication passage formed in the swing bush.

Preferably, the predetermined section in which the small space is brought into communication with the compression chamber is mainly a discharge stroke.

Preferably, the predetermined section in which the small space is brought into communication with the compression chamber is mainly the first half of a compression stroke.

Preferably, the small space is provided in the plural number and the predetermined section in which the small space comes into communication with the compression chamber is also provided in the plural number.

According to the third feature of the present invention there is provided a rotary compressor comprising a cylinder which defines a cylinder chamber, a piston disposed within the cylinder chamber, and a drive mechanism for driving the piston, the piston having a roller which performs a revolving motion within the cylinder chamber and a vane which, together with the roller, partitions the interior of the cylinder chamber into a suction chamber and a compression chamber, the roller and the vane being formed integrally with each other, wherein a swing bush which supports the vane so as to absorb advance and retreat motions and swing motion of the vane is provided in the cylinder, and a plurality of small spaces adapted to communicate with the compression chamber are provided so as to communicate with the compression chamber in a plurality of predetermined sections.

BRIEF DESCRIPTION OF THE DRAWINGS

FIG. 3(*b*) is an explanatory diagram of a communication section between a small space and a compression chamber at vane exposed length in the compression chamber relative to crank angles in the rotary compressor according to the present invention;

FIG. 4(*b*) is a diagram explaining the relation between crank angles and compression chamber pressures in the rotary compressor according to the present invention being used in a refrigerator;

DETAILED DESCRIPTION OF PREFERRED EMBODIMENTS

Figure 1:
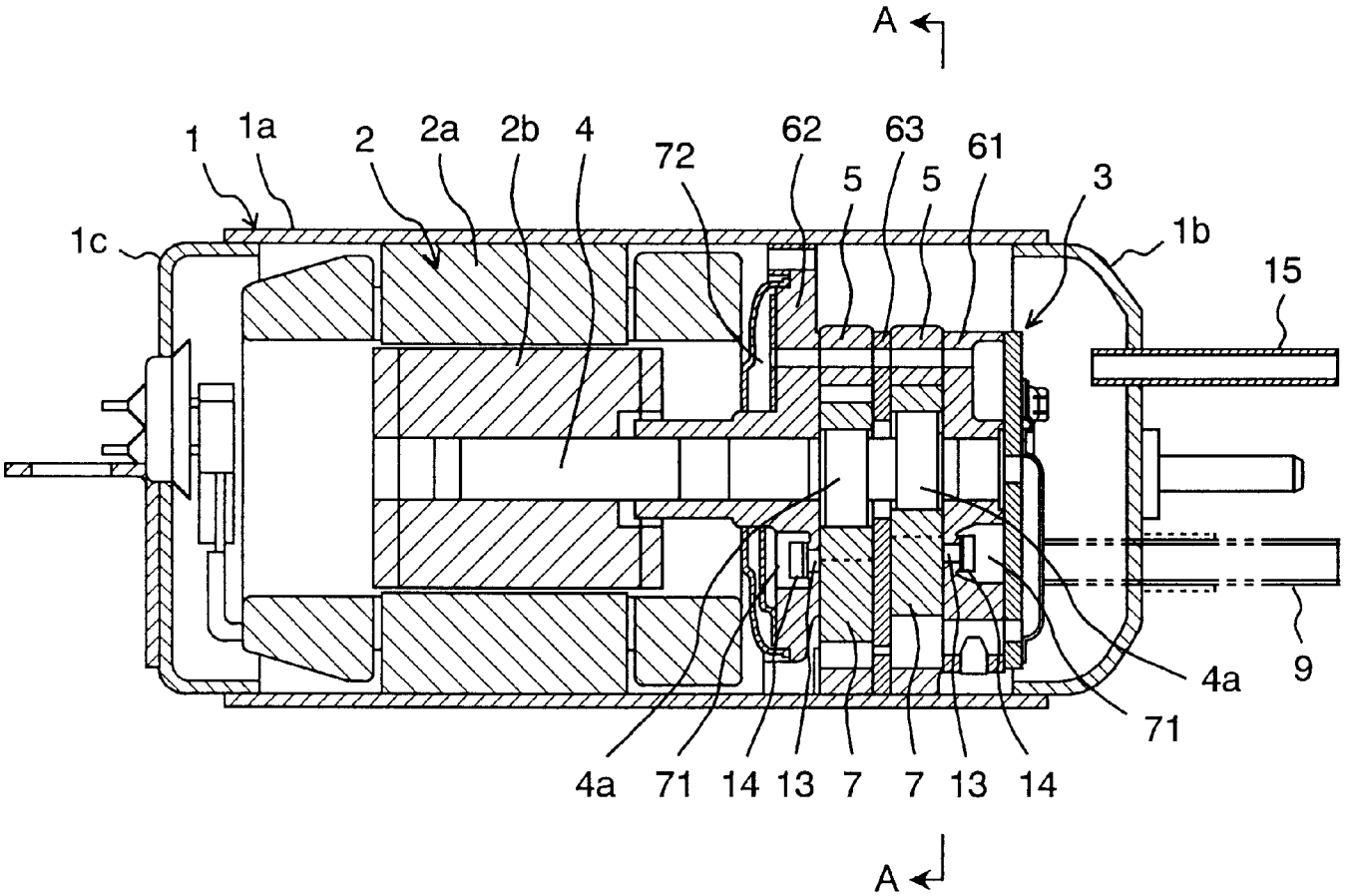
FIG. 1 is a longitudinal sectional view of a rotary compressor according to the first embodiment of the present invention.

Embodiments of the present invention will be described hereinunder with reference to the accompanying drawings. In the second and subsequent embodiments, constructional portions common to the first embodiment will partially be omitted, and in all of the embodiments the same reference numerals shown in the drawings represent the same or equivalent components.

The first embodiment of the present invention will be described below with reference to FIGS. 1 to 5.

Figure 2:
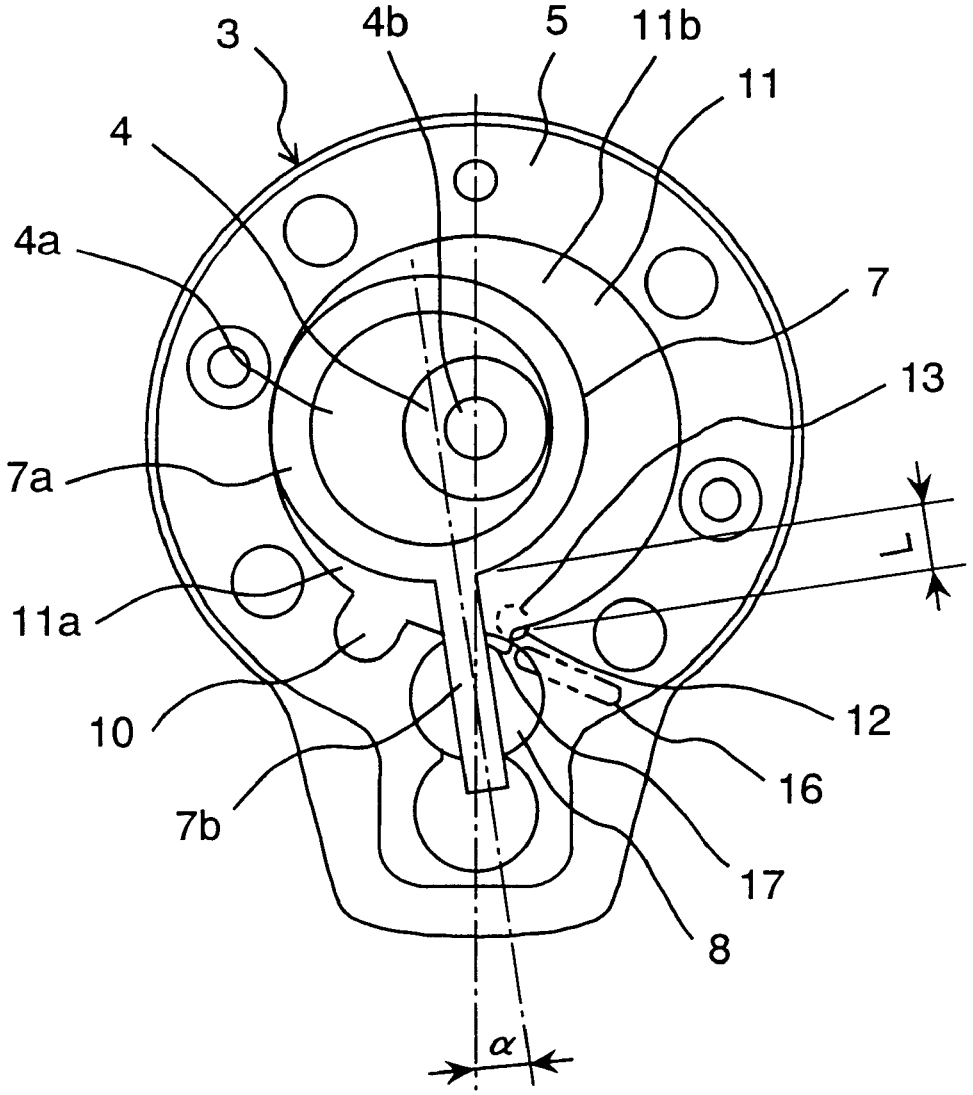
FIG. 2 is a sectional view taken on line A—A in FIG. 1, showing a compressing mechanism in the rotary compressor illustrated in FIG. 1.

As shown in FIGS. 1 and 2, a closed vessel 1 is composed of a cylindrical body portion 1*a* which is long horizontally and lid portions 1*b* and 1*c* located on both sides of the body portion 1*a*. An electric motor 2, a compressing mechanism 3 and a crank shaft 4 are accommodated within the closed vessel 1.

The electric motor 2 is provided with a stator 2*a* and a rotor 2*b*, the stator 2*a* being fixed to one side in the closed vessel and the rotor 2*b* disposed rotatably within the stator 2*a*.

The compressing mechanism 3 is provided with two cylinders 5, both-side end plates 61, 62, an intermediate end plate 63, two pistons 7, and two swing bushes 8. A roller 7*a* and a vane 7*b*, which constitute each piston 7, are integral with each other.

The two cylinders 5 hold the end plate 63 therebetween, and the end plates 61 and 62 are disposed on both sides thereof to define two spaces surrounded thereby as a cylinder chamber 11.

The cylinders 5 are each formed with a suction recess 10 and a discharge recess 12 in communication with the cylinder chamber 11. The discharge recesses 12 of the cylinders 5 are respectively in communication with discharge ports 13 formed in the end plates 61 and 62.

The compressing mechanism 3 is fixed through the end plate 61 to the opposite side in the closed vessel 1.

The crank shaft 4 is fixed on one side thereof to the rotor 2*b* of the electric motor 2 and is connected on the opposite side thereof to the compressing mechanism 3 and it is supported rotatably by bearings mounted to the end plates 61 and 62. The crank shaft 4 is formed with two eccentric portions 4*a* positioned inside the two rollers 7*a*. Further, the crank shaft 4 is centrally formed with an oiling hole 4*b* as a through hole.

Figure 5:
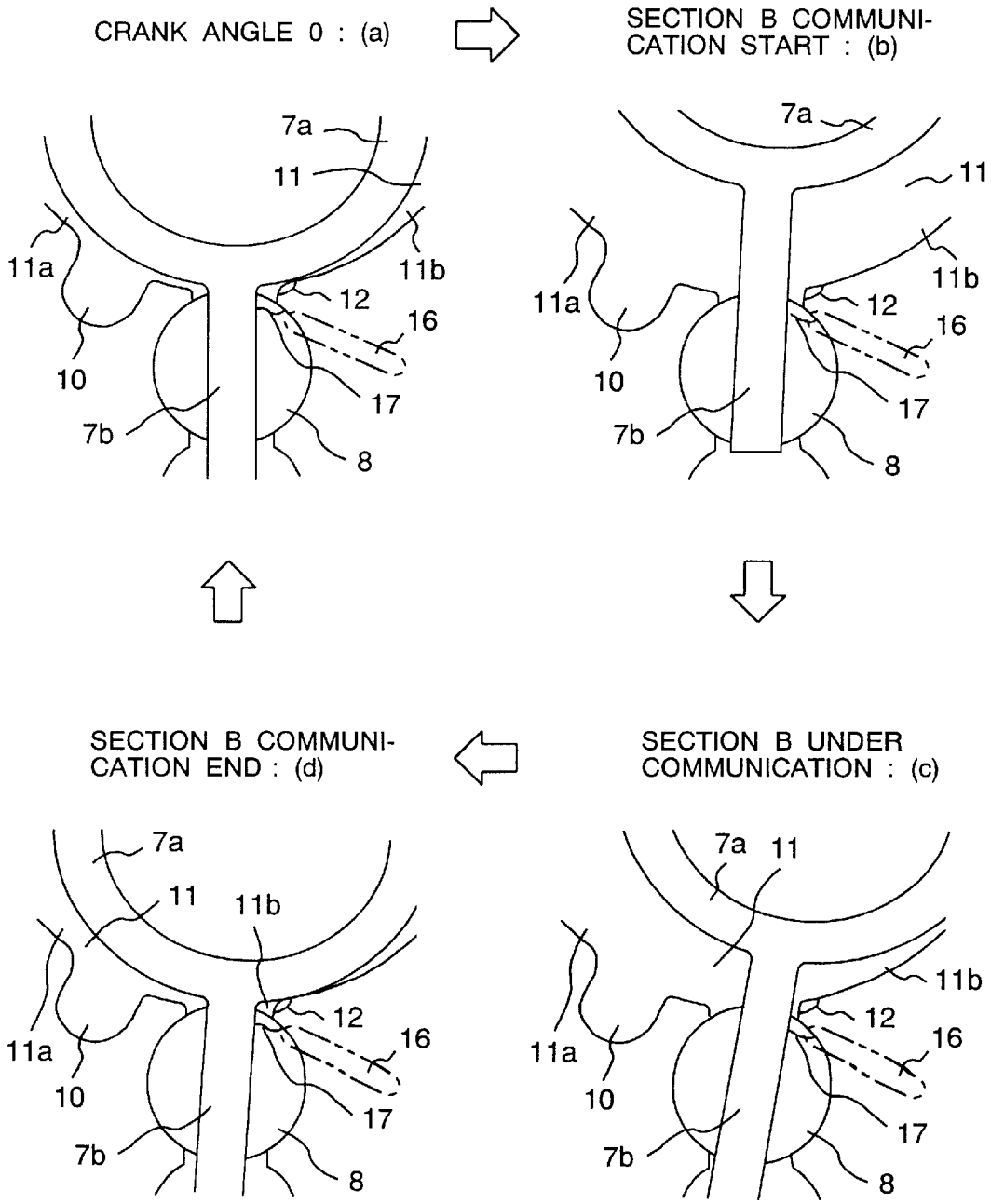
FIG. 5 is a diagram explaining the operation of the compressing mechanism in the rotary compressor shown in FIG. 1.

By charging the stator 2*a* of the electric motor 2 with an electric current, the rotor 2*b* rotates, so that the crank shaft 4 rotates and the two eccentric portions 4*a* of the crank shaft 4 rotate eccentrically within the two rollers 7. As a result, the rollers 7*a* perform a revolving motion within the cylinders 5, as shown in FIG. 5.

The vane 7*b* integral with each roller 7*a* is supported by the associated swing bush 8 so that it can advance or retreat at a exposed length L within the cylinder chamber 11 while swinging at a swing angle $\alpha$ relative to a center line with the revolving motion of the roller 7*a*. The vane 7*b* is disposed between the associated suction recess 10 and discharge recess 12 so as to partition the cylinder chamber 11 into a suction chamber 11*a* and a compression chamber 11*b*. The swing bush 8 is received in a recess of the cylinder 5 swingably.

A suction pipe 9 and a discharge pipe 15 are provided extending through the closed vessel 1 and are connected on one sided thereof to an exterior refrigerating cycle. The opposite side of the suction pipe 9 is in communication with the suction recess 10, while the opposite side of the discharge pipe 15 is in communication with a high-pressure space in the closed vessel.

Refrigerant gas introduced into the closed vessel through the suction pipe 9 is sucked into the cylinder chamber 11 through suction ports formed in the end plates 61 and 62 and further through the suction recesses 10 of the cylinders 5. The refrigerant thus sucked in is compressed by a change in volume of the cylinder chamber 11, then passes through the discharge recesses 12 of the cylinders 5, further through the discharge ports 13, pushes up discharge valves 14, and is discharged into first discharge silencers 71. The refrigerant thus discharged, which is high in pressure, passes through a second silencer 72 and is discharged to the interior space of the closed vessel 1. The refrigerant gas in the closed vessel 1 is discharged to the exterior refrigerating cycle through the discharge pipe 15.

By forming concave portions in the end plates 61 and 62, a small space 16 is defined by a space surrounded with the end plates 61, 62, cylinders 5 and swing bushes 8. The small space 16 is formed in proximity to the discharge recesses 12. A communication passage 17 is formed by cutting out a portion of each swing bush 8. The small space 16 communicates with the compression chamber 11*b* through the communication passage 17 in a predetermined section of the crank angle without coming into communication with the suction chamber 11*a*. In other words, the small space 16 communicates intermittently with the compression chamber 11*b* through the communication passage 17 without coming into communication with the suction chamber 11*a*.

Figure 3A:
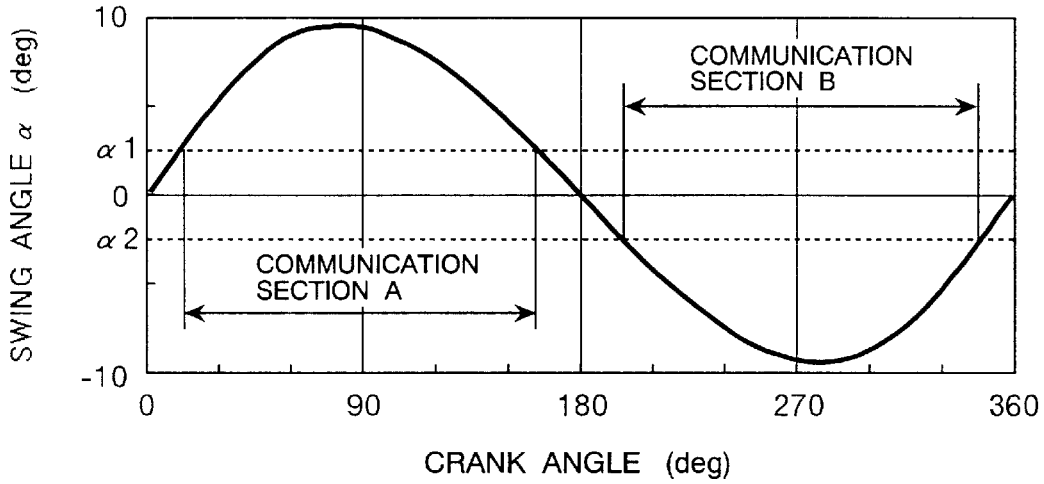
FIG. 3(*a*) is an explanatory diagram of a communication section between a small space and a compression chamber at swing angles relative to crank angles in a rotary compressor according to the present invention.
Figure 3B:
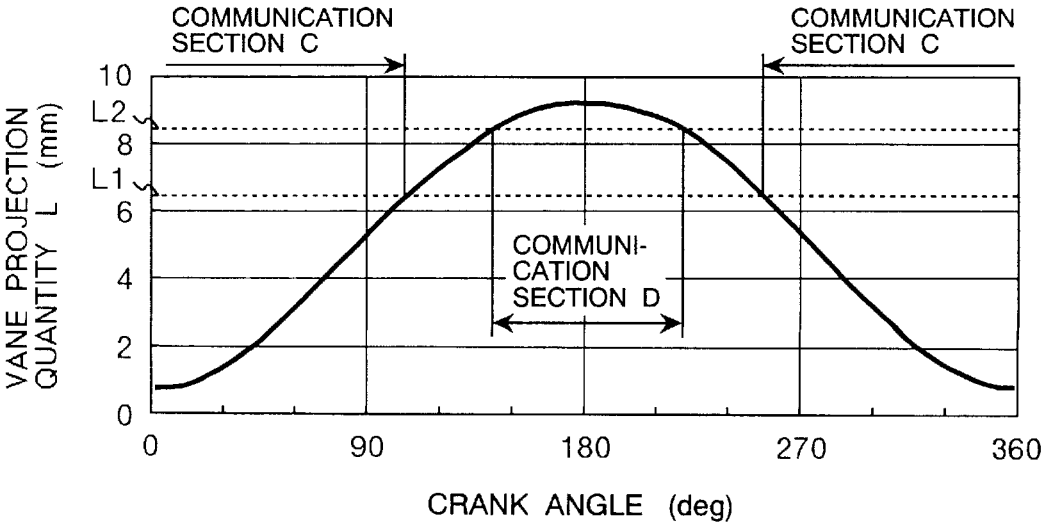

With reference to FIG. 3, the following description is provided about a basic idea of the communication relation between the small space 16 and the compression chamber 11*b*.

As shown in FIG. 3(*a*), the swing angle α of each swing piston 7 and each swing bush 8 varies in a sine wave form relative to the crank angle. As shown in FIG. 3(*b*), the projection quantity L of the vane 7*b* into the cylinder chamber 11 varies in a cosine wave form relative to the crank angle. The position corresponding to the minimum projection quantity L is used as a reference position of the crank angle.

Utilizing the swing motions of the swing piston 7 and the swing bush 8 which vary as above, the communication passage 17, for example, a recess, may be formed so that the small space 16 comes into communication with the compression chamber 11*b* at a swing angle of, for example, α1 or more, whereby it is made possible for the small space 16 to come into communication with the compression chamber 11*b* in a predetermined section A (communication section A shown in FIG. 3(A)) of a crank angle. Likewise, by providing the communication passage 17, for example, a recess, in such a manner that the small space 16 comes into communication with the compression chamber 11*b* at a swing angle of for example, α2 or less, it is made possible for the small space 16 to come into communication with the compression chamber 11*b* in a predetermined section B (communication section B shown in FIG. 3(*a*)) of a different crank angle.

On the other hand, utilizing a change in projection quantity L of the vane 7*b* into the compression chamber 11*b* caused by the advance or retreat motion of the vane, the communication passage 17, for example, a recess, may be formed in such a manner that the small space 16 comes into communication with the compression chamber 11*b* at a projection quantity L of, for example, L1 or less, whereby the small space 16 can be brought into communication with the compression chamber 11*b* in a predetermined section C (communication section C shown in FIG. 3(*b*)) of a different crank angle. Likewise, by providing the communication passage, for example, a recess, so as to provide communication of the small space 16 with the compression chamber 11*b* at a projection quantity of, for example, L2 or more, the small space 16 can be brought into communication with the compression chamber 11*b* in a predetermined section D (communication section D shown in FIG. 3(*b*)) of a different crank angle.

Further, by combining the communication sections A, B, C and D it is made possible for the small space 16 to come into communication with the compression chamber 11*b* limitatively in an overlapped communication section. It is here assumed that the communication section C is used in combination with the communication sections A and B and not used alone.

In the communication between the small space 16 and the compression chamber 11*b*, a desired section can be set by suitably selecting the swing angle α, vane projection quantity L, and the combination of communication sections A, B, C and D.

Next, with reference to FIG. 4, a description will be given below about the relation of communication between the small chamber 16 and the compression chamber 11*b*, which corresponds to the pressure of the compression chamber.

Figure 4A:
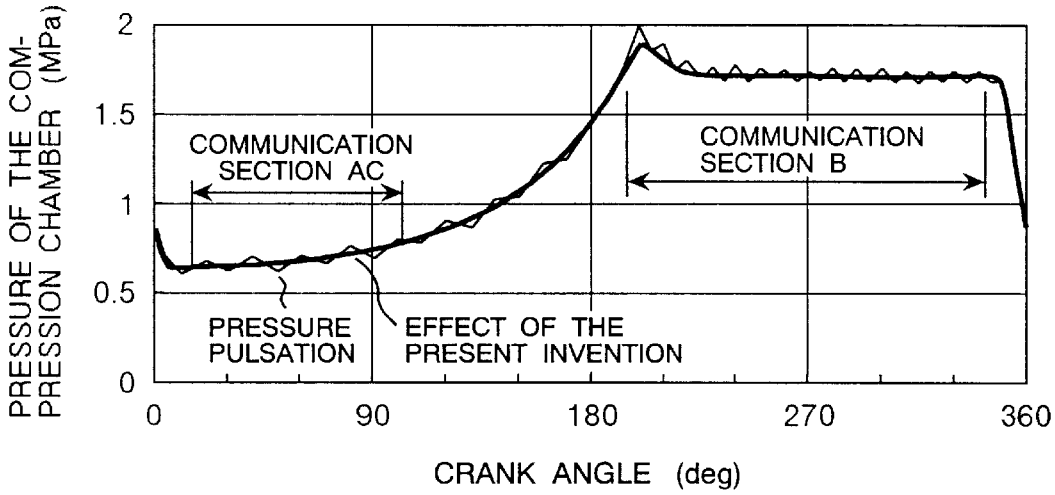
FIG. 4(*a*) is a diagram explaining the relation between crank angles and compression chamber pressures in the rotary compressor according to the present invention being used in an air conditioner.
Figure 4B:
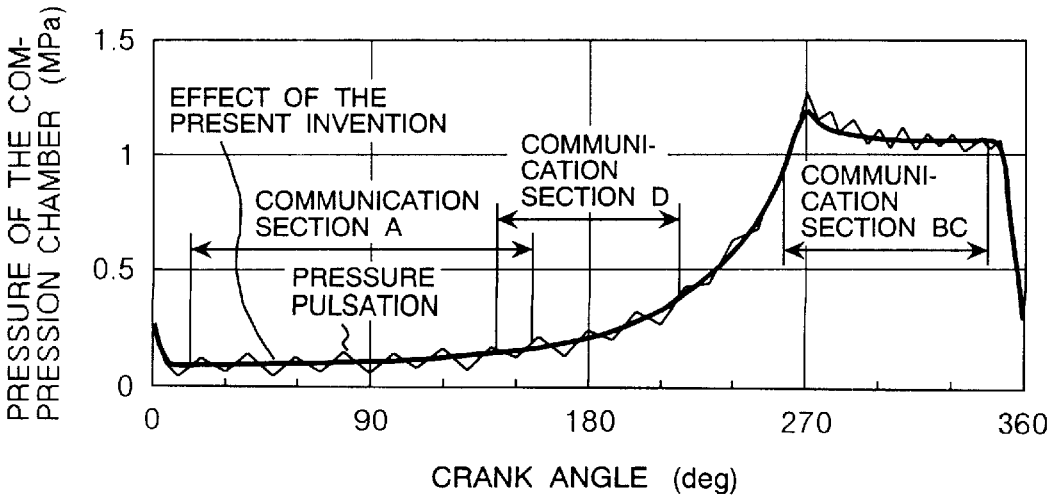

FIG. 4(*a*) shows an example of an operating condition of an air conditioner. For example, by providing the communication passage 17 so that the small space 16 comes into communication with the compression chamber 11*b* in the communication section B, it is possible to diminish the pressure fluctuation in the discharge stroke. It is also possible to decrease the re-expansion loss of the compressed refrigerant gas which remains in the small space 16 and prevent the deterioration of performance caused by return of the compressed refrigerant gas which remains in the small space 16 into the suction chamber 11*a*. Likewise, for example, by combining the communication sections A and C and providing the communication passage 17 so that the small space 16 communicates with the compression chamber 11*b* in an overlapped communication section AC of both communication sections A and C, it is possible to diminish the pressure fluctuation in the compression stroke. Besides, it is possible to decrease the re-expansion loss of the compressed refrigerant gas which remains in the small space 16 and also possible to prevent the deterioration of performance caused by return of the compressed refrigerant gas which remains in the small space 16 into the suction chamber 11*a*.

The reason why the pressure fluctuation in the discharge stroke or the compression stroke can be diminished is because the small space 16 is in communication with the compression chamber 11*b* and therefore the pressure fluctuation in the compression chamber caused by an abrupt pressure change upon discharge of the refrigerant gas from the discharge ports 13 or upon re-expansion of the compressed refrigerant gas which remains in the discharge ports 13, is mitigated.

The reason why not only the re-expansion loss of the compressed refrigerant gas which remains in the small space 16 can be diminished but also the deterioration of performance caused by return of the compressed refrigerant gas which remains in the small space 16 can be prevented, is that the small space 16 is provided which does not communicate with the suction chamber 11*a* but communicates with the compression chamber 11*b* in a predetermined section, thereby making it possible to diminish the difference between the pressure at which the small chamber 16 begins to communicate with the compression chamber 11*b* and the pressure at which the communication ends, and that therefore the compressed refrigerant gas which remained in the small chamber 16 at the end of communication does not re-expand at the beginning of communication, nor does it return to the suction chamber 11*a*.

FIG. 4(*b*) shows an example of an operating condition in a refrigerator. For example, by providing the communication passage 17 so that the small space 16 comes into communication with the compression chamber 11*b* in the communication section A, it is possible to diminish the pressure fluctuation in the compression stroke. Besides, it is possible to decrease the re-expansion loss of the compressed refrigerant gas which remains in the small space 16 and also possible to prevent the deterioration of performance caused by return of the compressed refrigerant gas which remains in the small space 16 into the suction chamber 11*a*. Likewise, by providing the communication passage 17 so that the small space 16 comes into communication with the compression chamber 11*b* in the communication section D, it is possible to diminish the pressure fluctuation in the compression stroke. Besides, it is possible to decrease the re-expansion loss of the compressed refrigerant gas which remains in the small space 16 and also possible to prevent the deterioration of performance caused by return of the compressed refrigerant gas which remains in the small space 16 into the suction chamber 11*a*. Further, by combining the communication sections B and C and by providing the communication path 17 so that the small space 16 communicates with the compression chamber 11*b* in an overlapped section BC of communication sections B and C, it is possible to decrease the pressure fluctuation in the discharge stroke. Besides, the re-expansion loss of the compressed gas which remains in the small space 16 can be decreased and the deterioration of performance caused by return of the compressed refrigerant gas from the small chamber 16 to the suction chamber 11*a* can be prevented.

By providing the small space 16 so as to communicate with the compression chamber 11*b* in a predetermined section exclusive of a rotational angle of the roller 7*a* at which the projection quantity of the vane 7*b* into the cylinder chamber 11 is the smallest, in other words, exclusive of the crank angle of zero, it is possible to diminish the deterioration of performance caused by a re-expansion loss which is attributable to a sudden drop of the compression chamber pressure in the section from the end of the discharge stroke up to the start of the compression stroke.

Constructing the compressor so as to provide the communication mainly in the discharge stroke is very effective in diminishing the pressure fluctuation in the compression chamber 11*b* caused by an abrupt pressure change upon discharge of the refrigerant gas from the discharge ports 13 and in decreasing the re-expansion loss.

Likewise, constructing the compressor so as to provide the communication mainly in the first half of the compression stoke is very effective in diminishing the pressure fluctuation in the compression chamber 11*b* caused by an abrupt pressure change upon re-expansion to the suction side of the compressed refrigerant gas remaining in the discharge ports 13.

Even with the construction wherein the communication is made halfway in the compression stroke, it is possible to diminish the pressure fluctuation in the latter half of the compression stroke if the pressure fluctuation is reduced halfway in the compression stroke.

Next, a concrete communication relation between the small space 16 and the compression chamber 11*b* will be described below with reference to FIG. 5.

As shown in FIG. 5, with the revolving motion of the roller 7*a,* the roller 7*a,* vane 7*b* and swing bush 8 shifts from state (a) to state (d). As a result, the relation of communication between the small chamber 16 and the compression chamber 11*b* changes from the state (a) in which both are out of communication with each other, then through the state (b) in which communication starts and the state (c) in which both are under communication with each other, to the state (d) in which the communication ends.

This embodiment is of the communication section B shown in FIG. 3(*a*). With the swing motion of the swing bush 8, the communication passage 17 communicates with the small space 16 in the section from state (b) to state (d) while being kept open to the compression chamber 11*b*. Consequently, in the predetermined section B of the crank angle the small space 16 comes into communication with the compression chamber 11*b* through the communication passage 17.

On this regard, a description will be given state by state. In the state (a) in which the crank angle and the swing angle are zero, the small space 16 is out of communication with the communication passage 17 and hence is not in communication with the compression chamber 11*b*. In the state (b) in which the swing angle $\alpha 2$ has become smaller than $\alpha 2$ with rotation of the roller 7*a,* the small space 16 is brought into communication with the communication passage 17 and the communication thereof with the compression chamber 11*b* is started. In the state (c) in which the roller has further rotated, the communication of the small chamber 16 with the communication passage 17 is continued and that with the compression chamber 11*b* is also continued. In the state (d) in which the swing angle has become larger than $\alpha 2$ with further rotation of the roller 7*a,* the communication of the small space 16 with the communication passage 17 ends and so does the communication thereof with the compression chamber 11*b*.

Therefore, for example in such an operating condition of the air conditioner as shown in FIG. 4(*a*), a pressure fluctuation (indicated with a thin solid line) in the discharge stroke represented by the communication section B can be diminished as indicated with a thick solid line and the deterioration of performance caused by the re-expansion loss and the suction chamber return loss can be reduced.

According to this embodiment it is possible to reduce a noise resulting from oscillation of components caused by the pressure fluctuation in the discharge stroke in the compression chamber; besides, the deterioration of performance caused by the re-expansion loss and the suction chamber return loss can be diminished. Thus, it is possible to attain both the reduction of noise and the improvement of performance.

Description will be directed below to the second embodiment of the present invention with reference of FIG.6.

In this second embodiment the position of the communication passage 17 formed in the swing bush 8 is different from that in the first embodiment.

Figure 6:
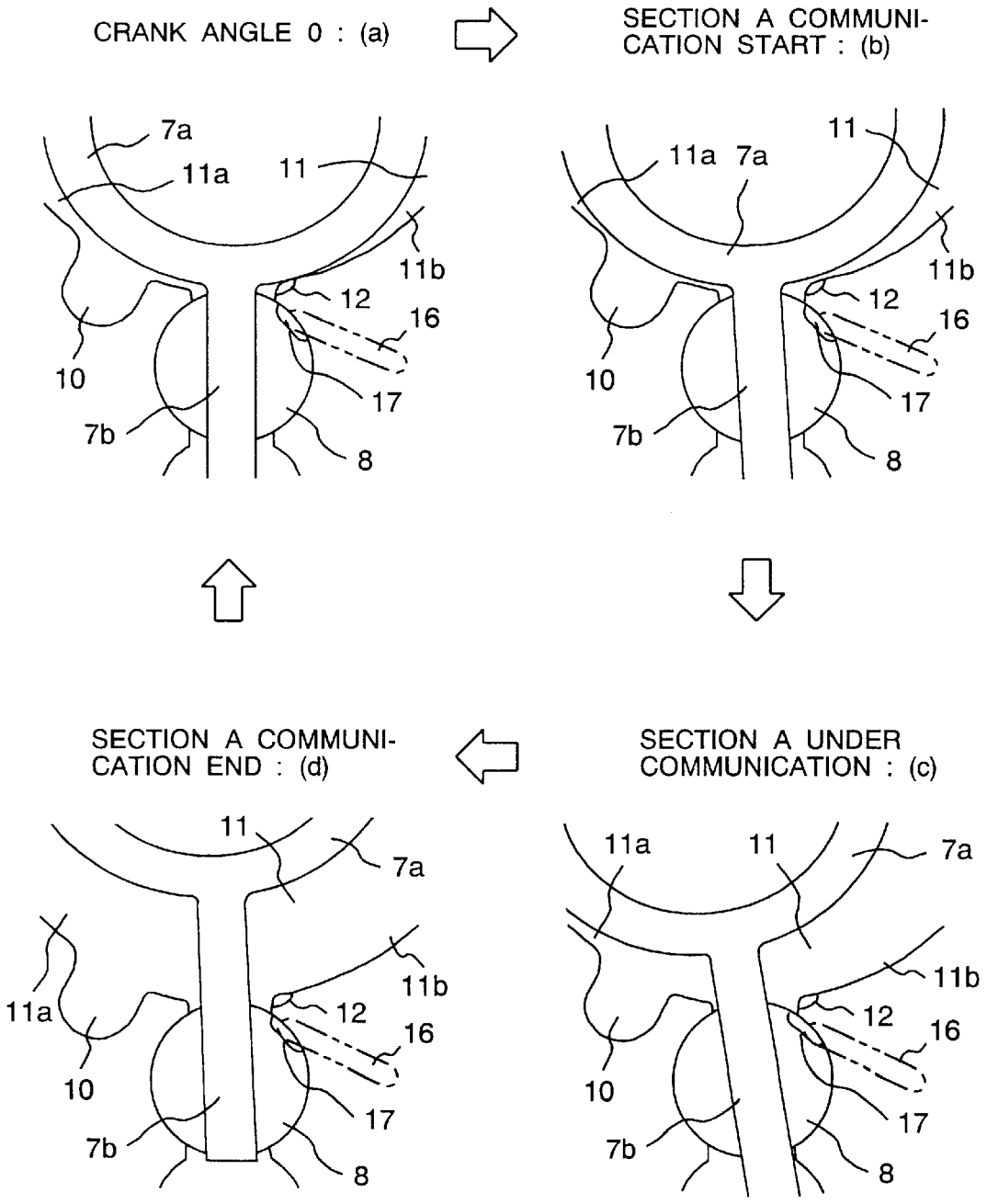
FIG. 6 is a diagram explaining the operation of a compressing mechanism in a rotary compressor according to the second embodiment of the present invention.

As shown in FIG. 6, with the revolving motion of the roller 7*a,* the roller 7*a,* vane 7*b* and swing bush 8 shift from state (a) tostate (d). As a result, the relation of communication between the small space 16 and the compression chamber 11*b* changes from the state (a) in which both are out of communication with each other, then through the state (b) in which communication starts and the state (c) in which both are under communication with each other, to the state (d)in which the communication ends.

This embodiment is of the communication section A shown in FIG. 3(*a*). With the swing motion of the swing bush 8, the communication passage 17 communicates with the compression chamber 11*b* in the section from state (b) to state (d) while being kept in communication with the small space 16. As a result, in the predetermined section A of the crank angle the small space 16 comes into communication with the compression chamber 11*b* through the communication passage 17.

On this regard, a description will be given state by state. In the state (a) in which the crank angle and the swing angle are zero, the communication passage 17 and the compression chamber 11*b* are out of communication with each other, so that the small chamber 16 is not in communication with the compression chamber 11*b* although it is in communication with the communication passage 17. In the state (b) in which the swing angle has become larger than $\alpha 1$ with rotation of the roller 7*a,* the communication passage 17 and the compression chamber 11*b* are brought into communication with each other, so that the small chamber 16 and the compression chamber 11*b* begin to communicate with each other. In the state (c) in which the roller 7*a* has further rotated, the communication between the small space 16 and the compression chamber 11*b* is continued. In the state (d) in which the swing angle has become smaller than α1 with further rotation of the roller 7*a,* the communication between the communication passage 17 and the compression chamber 11*b* is ended, so that the communication between the small space 16 and the compression chamber 11*b* is also terminated.

Therefore, for example in such an operating condition of the refrigerator as shown in FIG. 4(*b*), a pressure fluctuation (indicated with a thin solid line) in the compression stroke represented by the communication section A can be diminished as indicated with a thick solid line. Moreover, it is possible to decrease the deterioration of performance caused by the re-expansion loss and the suction chamber return loss.

Figure 7:
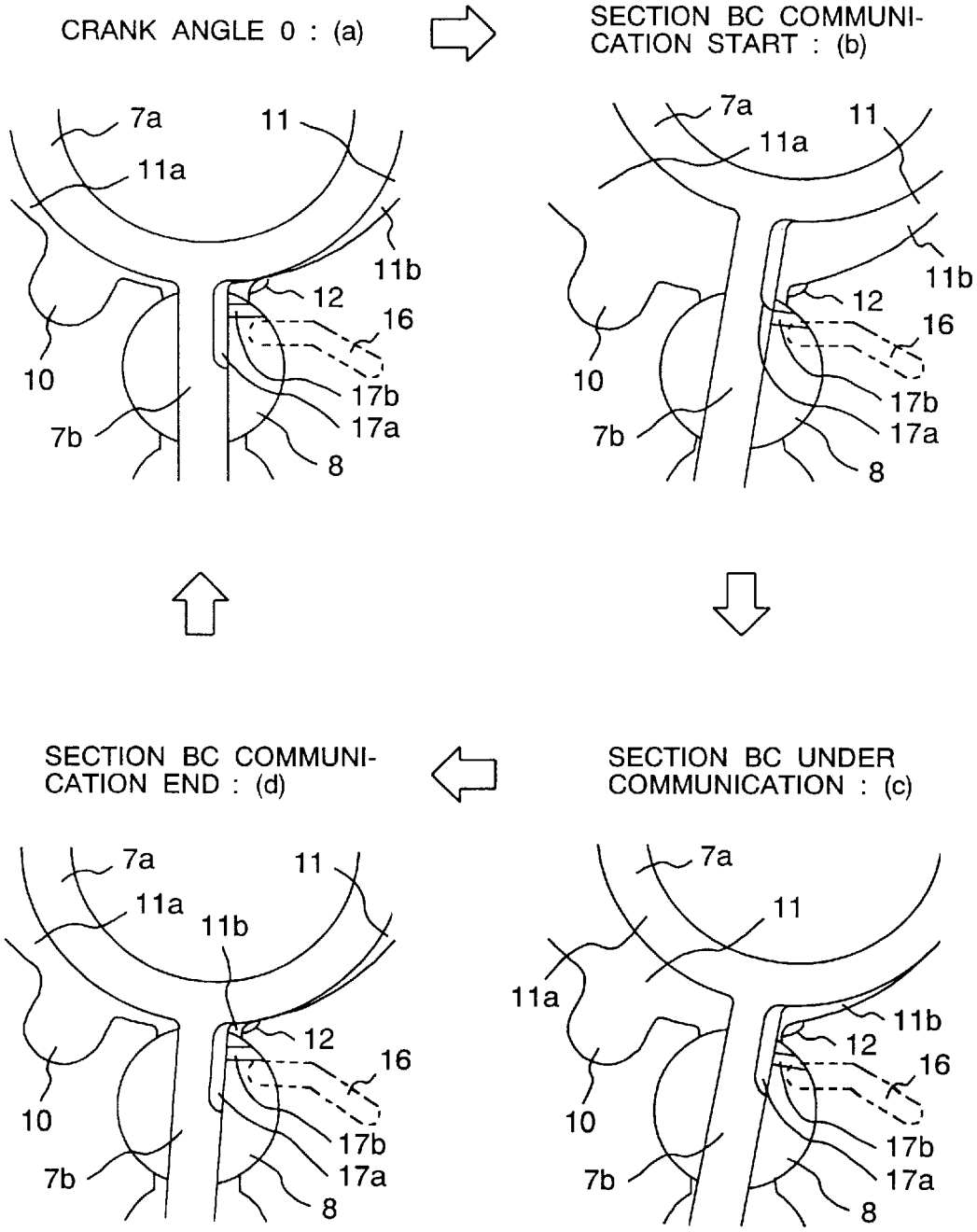
FIG. 7 is a diagram explaining the operation of a compressing mechanism in a rotary compressor according to the third embodiment of the present invention.

With reference to FIG. 7, the following description is provided about the third embodiment of the present invention.

In this third embodiment, the small space 16 is brought into communication with the compression chamber 11*b* through a first communication passage 17*a* formed in the vane 7*b* and a second communication passage 17*b* formed in the swing bush 8. In this point the third embodiment is different from the first embodiment.

As shown in FIG. 7, with the revolving motion of the roller 7*a,* the roller 7*a,* vane 7*b* and swing bush 8 shift from state (a) to state (d). As a result, the relation of communication between the small space 16 and the compression chamber 11*b* changes from the state (a) in which both are out of communication with each other, then through the state (b) in which communication starts and the state (c) in which both are under communication with each other, to the state (d) in which the communication ends.

In this embodiment, the communication section B shown in FIG. 3(*a*) and the communication section C shown in FIG. 3(*b*) are combined with each other. More specifically, with advance or retreat motion of the vane 7*b* and swing motion of the swing bush 8, the small space 16 communicates with the compression chamber 11*b* in the section from state (b) to state (d) through the first and second communication passages 17*a,* 17*b*. Thus, the communication of the small chamber 16 with the compression chamber 11*b* is provided in the predetermined section BC of the crank angle.

Reference will be made to this point state by state. In the state (a) in which the crank angle and the swing angle are zero, communication is provided between the small space 16 and the second communication passage 17*b,* so that the small chamber 16 does not communicate with the compression chamber 11*b*. When the roller 7*a* rotates and the swing angle becomes smaller than α2, the small chamber 16 and the second communication passage 17*b* are brought into communication with each other. But in a section in which the projection quantity of the vane 7*b* is larger than L1, the small chamber 16 is not brought into communication with the compression chamber 11*b* because the first and second communication passages 17*a,* 17*b* are out of communication with each other. In the state (b) in which the roller 17*a* has further rotated, the projection quantity of the vane 7*b* becomes smaller than L1 and the first and second communication passages 17*a,* 17*b* are brought into communication with each other, so that the small chamber 16 begins to communicate with the compression chamber 11*b*. In the state (c) in which the roller 7*a* has further rotated, the small space 16 and the compression chamber 11*b* are kept in communication with each other. In the state (d) in which the swing angle has become larger than α2 with further rotation of the roller 7*a,* the communication between the small space 16 and the second communication passage 17*b* is ended and so is the communication between the small space 16 and the compression chamber 11*b*.

Therefore, for example in such an operating condition of the refrigerator as shown in FIG. 4(*b*), a pressure fluctuation (indicated with a thin solid line) in the discharge stroke represented by the communication section BC can be diminished as indicated with a thick solid line and it is possible to decrease the deterioration of performance caused by the re-expansion loss and the suction chamber return loss.

Figure 8:
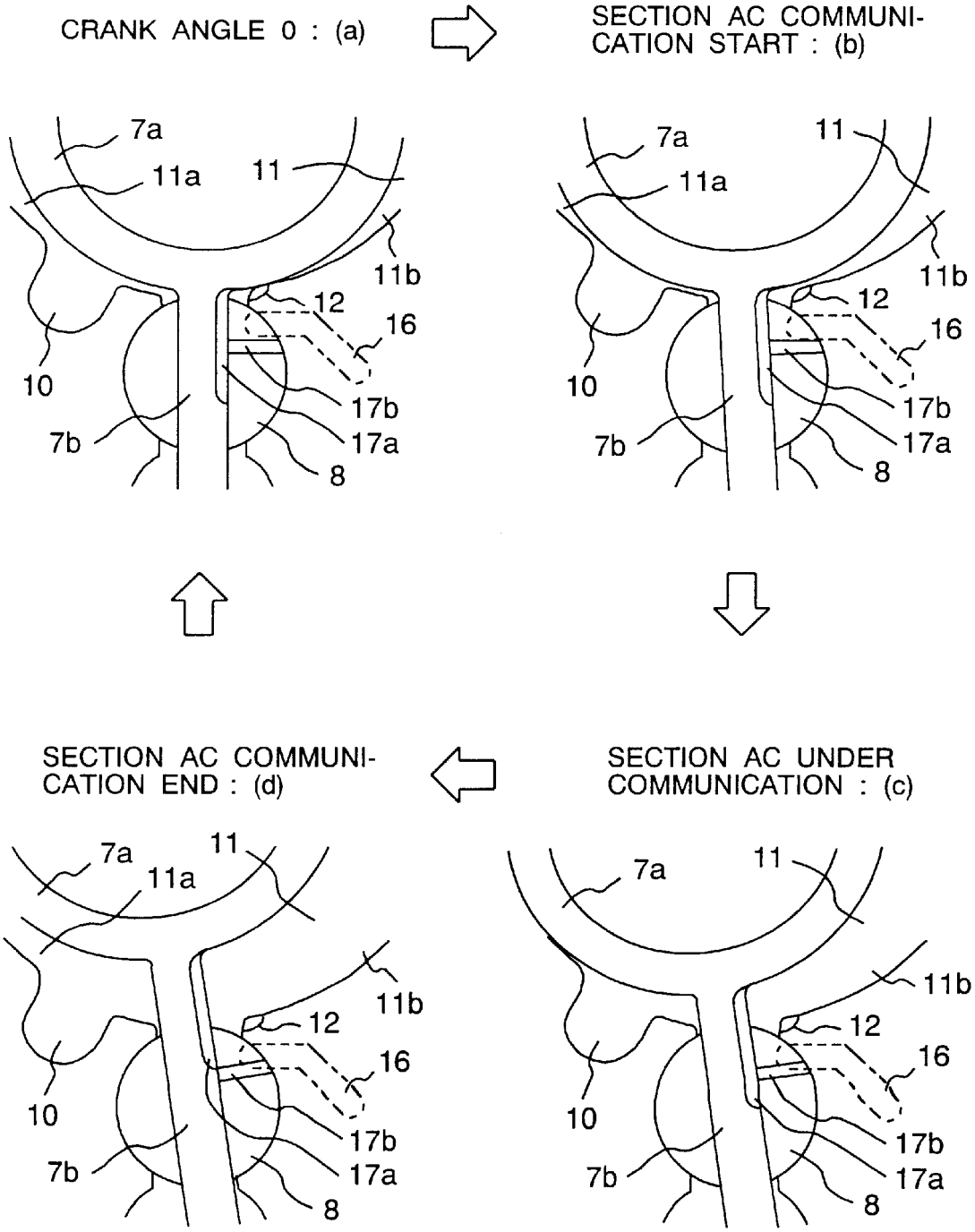
FIG. 8 is a diagram explaining the operation of a compressing mechanism in a rotary compressor according to the fourth embodiment of the present invention.

With reference to FIG. 8, the following description is provided about the fourth embodiment of the present invention. In this fourth embodiment, the position where a small space 16 formed in the end plate 61, a first communication passage 17*a* formed in the vane 7*b* and a second communication passage 17*b* formed in the swing bush 8 communicate with one another is different from that in the third embodiment.

As shown in FIG. 8, with the revolving motion of the roller 7*a,* the roller 7*a,* vane 7*b* and swing bush 8 shift from state (a) to state (d). As a result, the relation of communication between the small space 16 and the compression chamber 11*b* changes from the state (a) in which both are out of communication with each other, then through the state (b) in which communication starts and the state (c) in which both are under communication, to the state (d) in which the communication ends.

In this embodiment, the communication section A shown in FIG. 3(*a*) and the communication section C shown in FIG. 3(*b*) are combined into a communication section AC. More specifically, with advance or retreat motion of the vane 7*b* and swing motion of the swing bush 8, the small space 16 communicates with the compression chamber 11*b* in the section from state (b) to state (d) through the first and second communication passages 17*a,* 17*b*. Thus, the communication of the small chamber 16 with the compression chamber 11*b* is provided in the predetermined section AC of the crank angle.

This point will be described state by state. In the state (a) in which the crank angle and the swing angle are zero, no communication is provided between the small chamber 16 and the second communication passage 17*b,* so that the small chamber 16 is out of communication with the compression chamber 11*b*. In the state (b) in which the projection quantity of the vane 7*b* has become smaller than L1 and the swing angle larger than α1 with rotation of the roller 7*a,* the small space 16 and the second communication passage 17*b* are brought into communication with each other, so that the small space 16 and the compression chamber 11*b* begin to communicate with each other. In the state (c) in which the roller 7*a* has further rotated, the small space 16 and the compression chamber 11*b* are kept in communication with each other. In the state (d) in which the projection quantity of the vane 7*b* has become larger than L1 with further rotation of the roller 7*a,* the communication between the first and second communication passages 17*a,* 17*b* is ended and so is the communication between the small space 16 and the compression chamber 11*b*.

Consequently, for example in such an operating condition of the air conditioner as shown in FIG. 4(*a*), a pressure fluctuation (indicated with a fine solid line) in the compression stroke represented by the communication section AC can be diminished as indicated with a thick solid line. It is also possible to decrease the deterioration of performance caused by the re-expansion loss and the suction chamber return loss.

Figure 9:
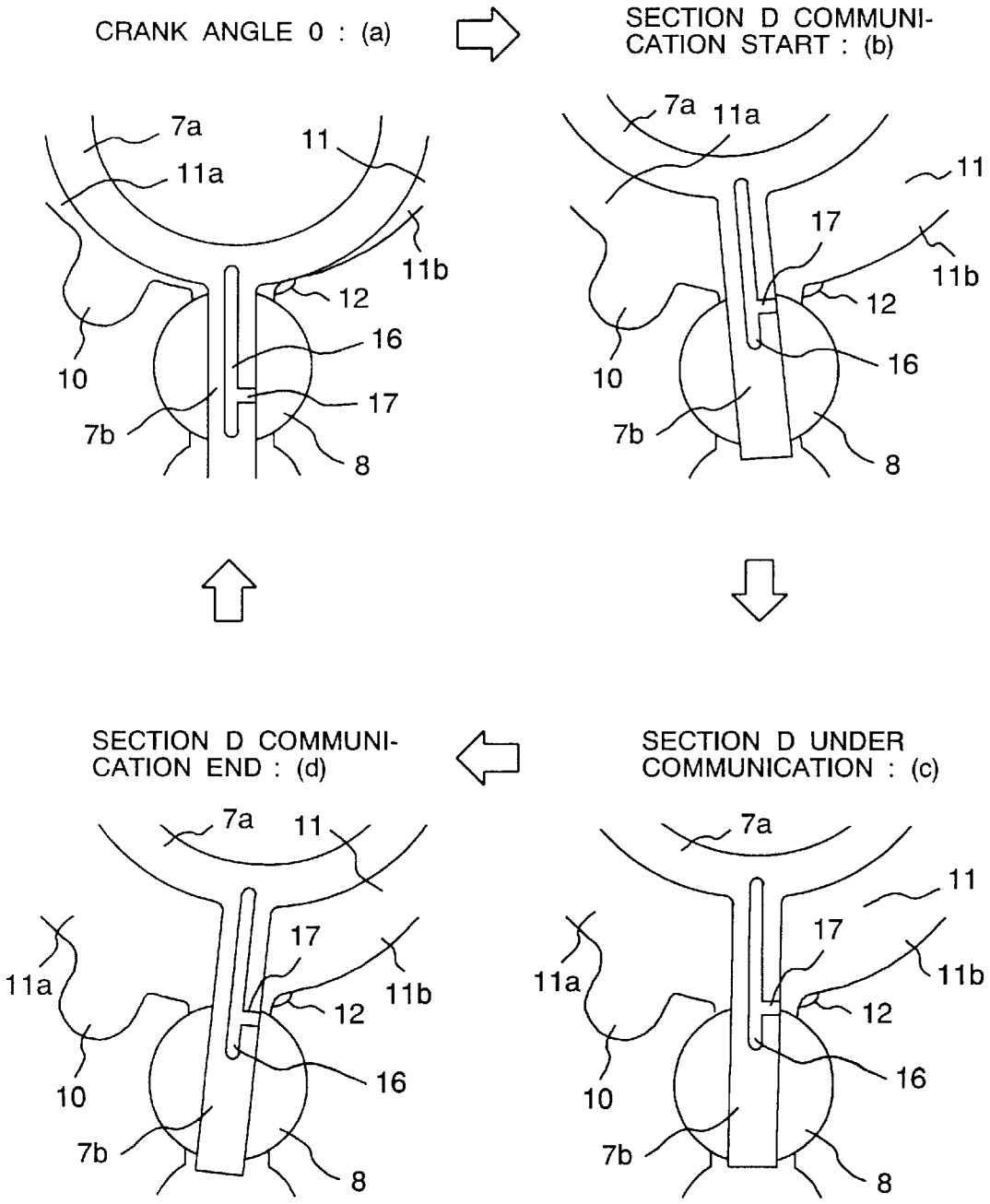
FIG. 9 is a diagram explaining the operation of a compressing mechanism in a rotary compressor according to the fifth embodiment of the present invention.

Next, with reference to FIG. 9, the following description is provided about the fifth embodiment of the present invention.

This fifth embodiment is different from the previous embodiments in point of a small space 16 and a communication passage 17 being formed in the vane 7*b* and also in point of the section of communication between the small chamber 16 and the compression chamber 11*b*.

As shown in FIG. 9, with the revolving motion of the roller 7*a,* the roller 7*a,* vane 7*b* and swing bush 8 shift from state (a) to state (d). As a result, the relation of communication between the small chamber 16 and the compression chamber 11*b* changes from the state (a) in which both are out of communication with each other, then through the state (b) in which communication starts and the state (c) in which both are under communication with each other, to the state (d) in which the communication ends.

This embodiment is of the communication section D shown in FIG. 3(*b*). With advance or retreat motion of the vane 7*b,* the small space 16 comes into communication with the compression chamber 11*b* through the communication passage 17 in the section from state (b) to state (d). Thus, the communication of the small space 16 with the compression chamber 11*b* is provided in the predetermined section D of the crank angle.

This point will be described state by state. In the state (a) in which the crank angle and the swing angle are zero, the communication passage 17 and the compression chamber 11*b* are out of communication with each other and therefore the small space 16 is not brought into communication with the compression chamber 11*b*. In the state (b) in which the projection quantity of the vane 7*b* has become larger than L2 with rotation of the roller 7*a,* the communication passage 17 and the compression chamber 11*b* are brought into communication with each other, so that the small space 16 and the compression chamber 11*b* begin to communicate with each other. In the state (c) in which the roller 7*a* has further rotated, the small space 16 and the compression chamber 11*b* are kept in communication with each other. In the state (d) in which the projection quantity of the vane 7*b* has become smaller than L2 with a still further rotation of the roller 7*a,* the communication between the communication passage 17 and the compression chamber 11*b* is ended, so that the communication between the small space 16 and the compression chamber 11*b* is also ended.

Therefore, for example in such an operating condition of the refrigerator as shown in FIG. 4(*b*), a pressure fluctuation (indicated with a thin solid line) in the compression stroke represented by the communication section D can be diminished as indicated with a thick solid line. It is also possible to decrease the deterioration of performance caused by the re-expansion loss and the suction chamber return loss.

Figure 10:
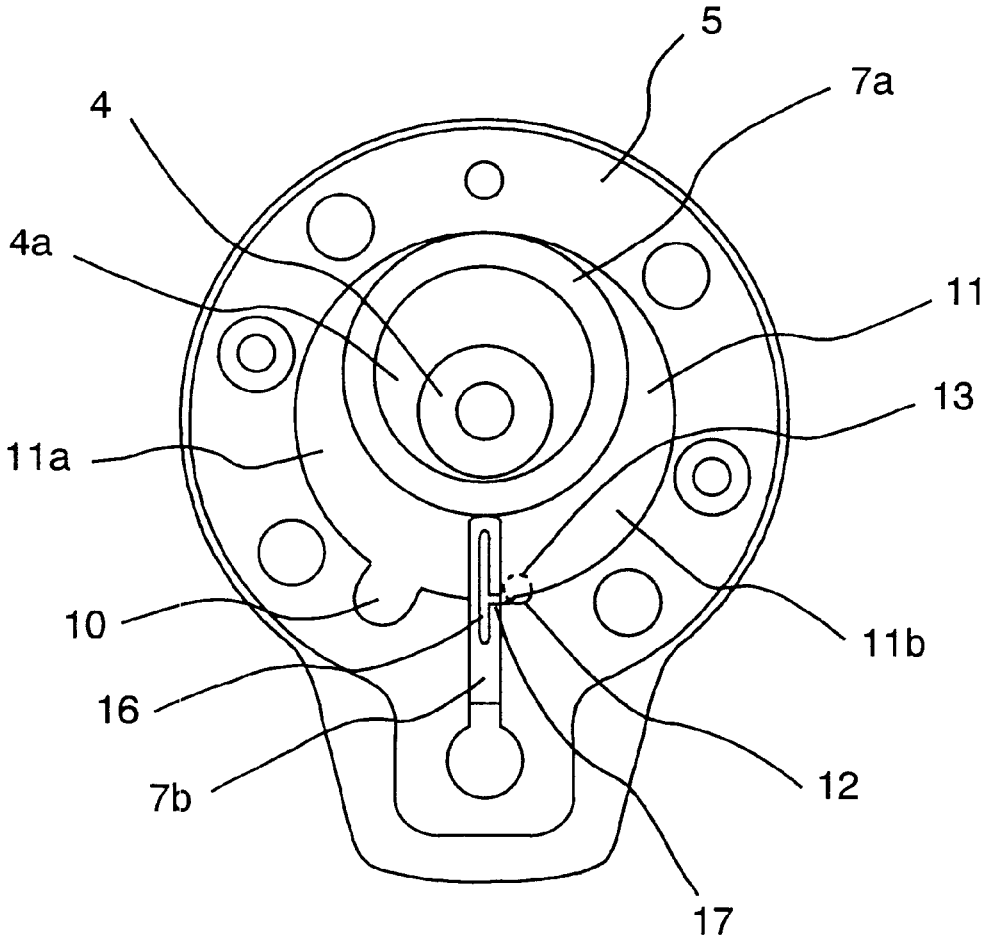
FIG. 10 is a schematic sectional view of a compressing mechanism in a rotary compressor according to the sixth embodiment of the present invention.

With reference to FIG. 10, a description will be given below about the sixth embodiment of the present invention.

This sixth embodiment is different from the fifth embodiment in that the roller 7*a* and the vane 7*b* are formed as separate components, that the vane 7*b* is received slidably in a groove of the cylinder 5, and that the vane 7*b* is kept in abutment with the roller 7*a*. The operation of this embodiment is basically the same as that of the fifth embodiment and therefore an explanation thereof will here be omitted.

Next, the seventh embodiment of the present invention will be described below with reference to FIG. 11.

This seventh embodiment is different from the previous embodiments in that a plurality of small spaces 161, 162 and a plurality of communication passages are provided and that the plural small spaces 161, 162 and the plural communication passages are combined together to establish a plurality of communication sections.

The small space 161 is constituted of a recess formed in the end plate 61. The small space 161 is brought into communication with the compression chamber 11*b* through a communication passage 171 formed on the end plate 61 side of the vane 7*b*. The small space 162 is constituted of a hole formed in the end plate 63. The small space 162 is brought into communication with the compression chamber 11*b* through a first communication passage 172*a* formed on the end plate 63 side of the vane 7*b*, a second communication passage 172*b* formed on the end plate 63 side of the swing bush 8, and a third communication passage 172*c* formed on the end plate 63 side of cylinder 5.

Figure 11:
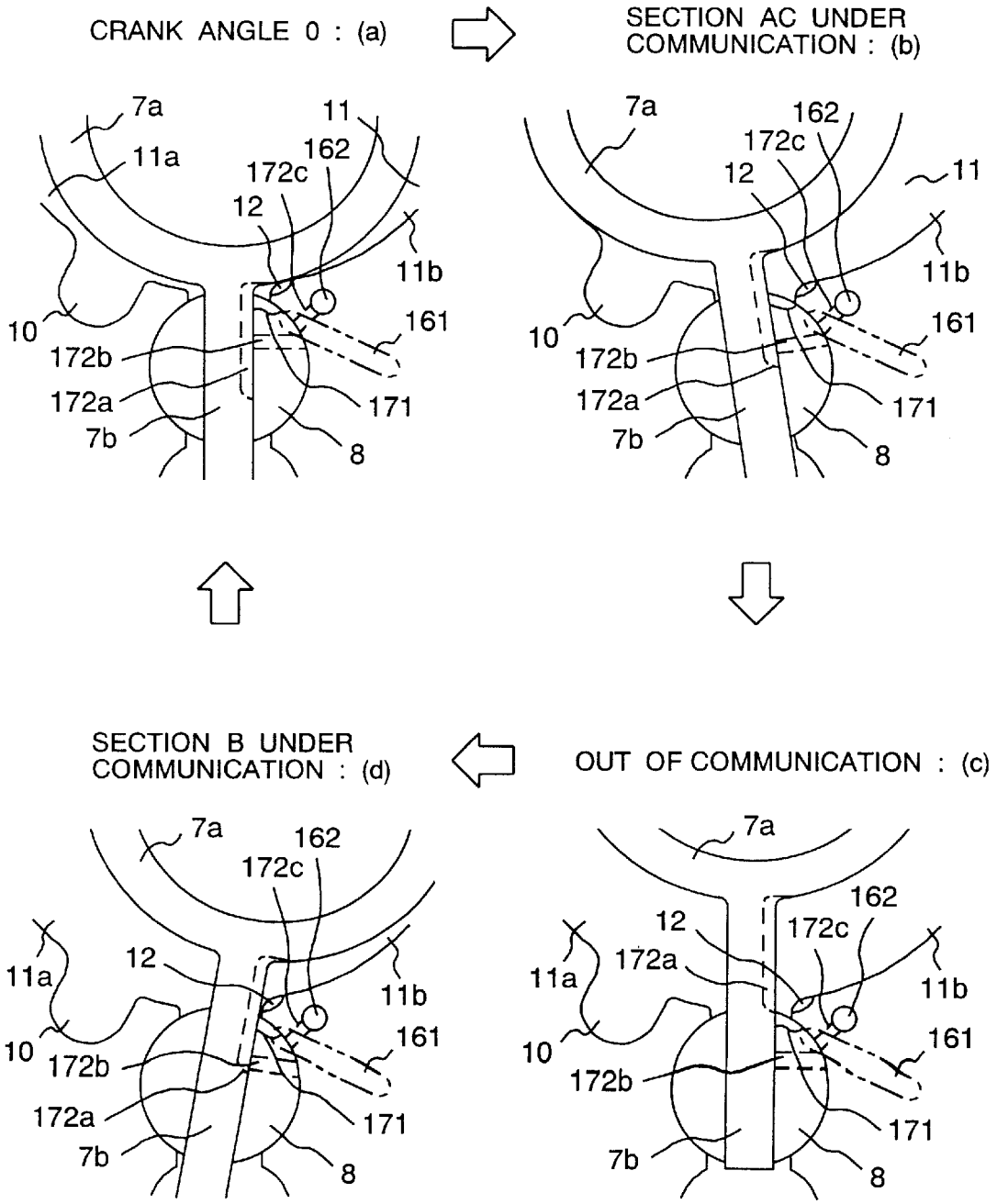
FIG. 11 is a diagram explaining the operation of a compressing mechanism in a rotary compressor according to the seventh embodiment of the present invention.

As shown in FIG. 11, with the revolving motion of the roller 7*a,* the roller 7*a,* vane 7*b* and swing bush 8 shift from state (a) to state (d). As a result, the relation of communication between the small spaces 161, 162 and the compression chamber 11*b* changes from the state (a) in which both are out of communication with each other, then through the state (b) in which both are under communication with each other and the state (c) in which both are out of communication with each other, further through the state (d) in which both are under communication with each other, to the out-of-communication state (a).

This embodiment involves a plurality of communication sections which are the communication section AC as a combination of the communication section A in FIG. 3(*a*) and the communication section C in FIG. 3(*b*), as well as the communication section B in FIG. 3(*a*). More specifically, with advance and retreat motion of the vane 7*b* and swing motion of the swing bush 8, the small space 162 is brought into communication with the compression chamber 11*b* through the communication passages 172*a*, 172*b* and 172*c* in the communication section AC by the same operation as in the fourth embodiment. The small space 161 is brought into communication with the compression chamber 11*b* through the communication passage 171 in the communication section B by the same operation as in the first embodiment.

According to this seventh embodiment, for example in such an operating condition of the air conditioner as shown in FIG. 4(*a*), a pressure fluctuation (indicated with a thin solid line) in both the compression stroke represented by the communication section AC and the discharge stroke represented by the communication section B can be to diminished as indicated with a thick solid line. It is also possible to decrease the deterioration of performance caused by the re-expansion loss and the suction chamber return loss.

Next, the eighth embodiment of the present invention will be described below with reference to FIG. 12.

In this eighth embodiment, the communication section between the small space 161 and the compression chamber 11*b* and that between the small space 162 and the compression chamber 11*b* are different from those in the seventh embodiment.

Figure 12:
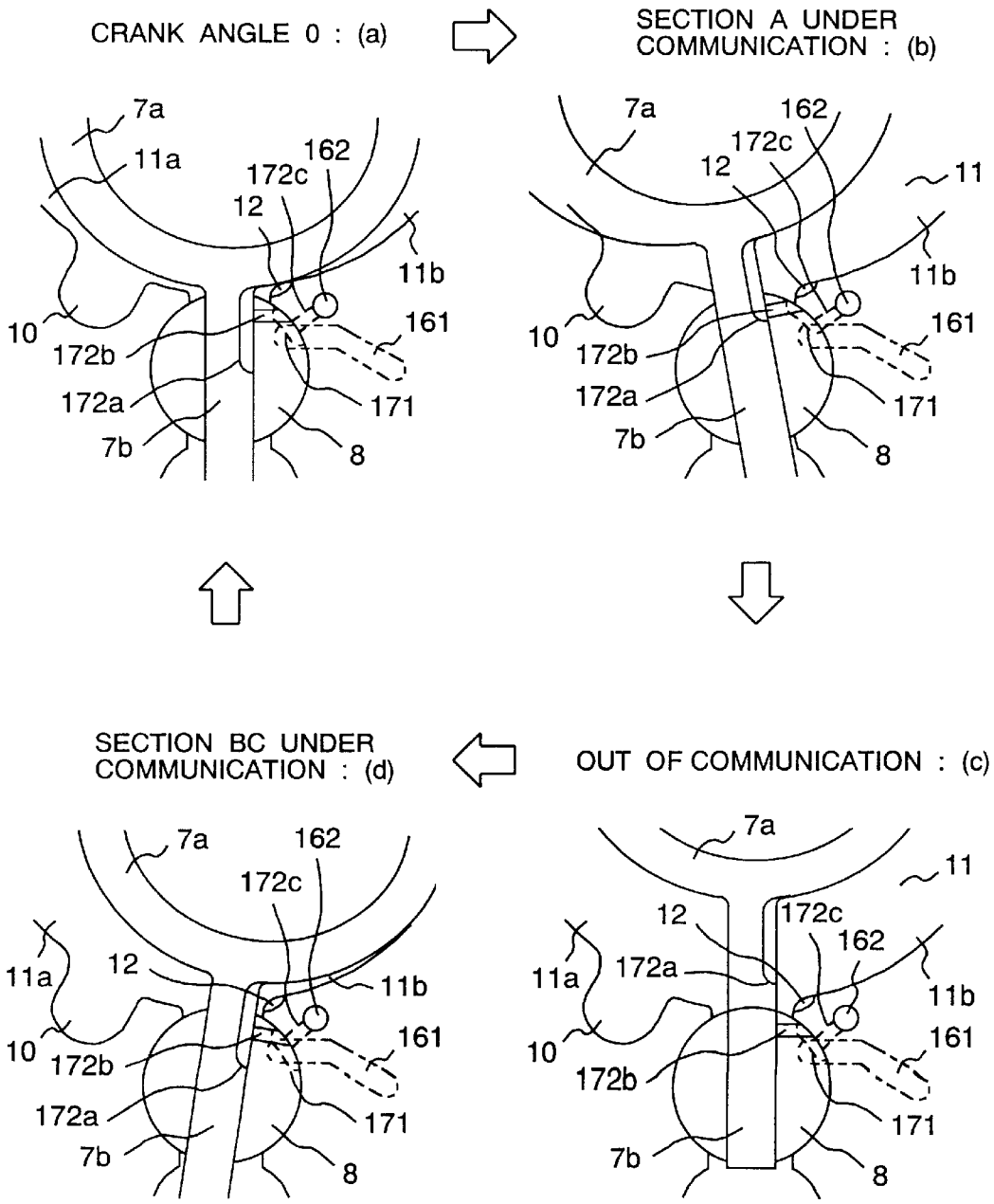
FIG. 12 is a diagram explaining the operation of a compressing mechanism in a rotary compressor according to the eighth embodiment of the present invention.

As shown in FIG. 12, with the revolving motion of the roller 7*a,* the roller 7*a,* vane 7*b* and swing bush 8 shift from state (a) to state (d). As a result, the relation of communication between the small spaces 161, 162 and the compression chamber 11*b* changes from the state (a) in which both are out of communication from each other, then through the state (b) in which both are under communication with each other and the state c) in which both are out of communication with each other, further through the state (d) in which both are under communication with each other, to the out-of-communication state (a).

This embodiment involves a plurality of communication sections which are the communication section A shown in FIG. 3(*a*) and a combination of the communication section B shown in FIG. 3(*a*) and the communication section C in FIG. 3(*b*). With advance or retreat motion of the vane 7*b* and swing motion of the swing bush 8, the small space 162 is brought into communication with the compression chamber 11*b* through the communication passages 171 and 172*c* in the communication section A by the same operation as in the second embodiment. The small space 161 is brought into communication with the compression chamber 11*b* through the communication passages 172*a* and 172*b* in the communication section BC by the same operation as in the third embodiment.

According to this embodiment, for example in such an operating condition of the refrigerator as shown in FIG. 4(*b*), a pressure fluctuation (indicated with a thin solid line) in both the compression stroke represented by the communication section A and the discharge stroke represented by the communication section BC can be diminished as indicated with a thick solid line. It is also possible to reduce the deterioration of performance caused by the re-expansion loss and the suction chamber return loss.

Although the description of each of the above embodiments is concerned with one cylinder side, it is also applied to the other cylinder side. Also as to the number of cylinder, it is not limited to two. One cylinder or any other number of cylinders will do. The present invention is also applicable to a multi-stage compression.

Although in each of the above embodiments the small space is formed in an end plate or the vane, it may be formed, for example, in the swing bush. A communication passage may be formed in an end plate or a cylinder and the small space may be formed as a separate part.

According to the embodiments of the present invention, since the small space 16 is present so as to communicate with the compression chamber 11*b,* the pressure fluctuation in the compression chamber 11*b* caused by an abrupt pressure change upon discharge of the refrigerant gas from the discharge ports 13 or upon re-expansion of the compressed refrigerant gas which remains in the discharge ports 13 is mitigated, whereby a noise resulting from the pressure fluctuation can be reduced.

Moreover, since the small space 16 is present which does not communicate with the suction chamber 11*a* but communicates with the compression chamber 11*b* in a predetermined section, it is possible to diminish the difference between the pressure at the end of communication between the small space 16 and the compression chamber 11*b* and the pressure at the beginning of the communication. Therefore, the compressed refrigerant gas which remains in the small space 16 at the end of communication scarcely undergoes re-expansion at the beginning of communication and does not return to the suction chamber 11*a.* Thus, not only it is possible to diminish the re-expansion loss of the compressed refrigerant gas which remains in the small space 16, but also it is possible to prevent the deterioration of performance caused by return of the refrigerant gas to the suction chamber 11*a.*

Further, a small space 16 is provided so as to communicate with the compression chamber 11*b* in a predetermined section exclusive of a rotational angle of the roller corresponding to a minimum projection quantity L of the vane 7*b* into the cylinder chamber 11. It is possible to diminish the deterioration of performance caused by a re-expansion loss which is attributable to a sudden drop of the compression chamber pressure in the section from the end of the discharge stroke up to the start of the compression stroke.

Moreover, since the communication passage 17 for communication of the small space 16 with the compression chamber 11*b* is formed in the swing bush 8, a simple construction permits the communication passage 17 to provide communication between the small space 16 and the compression chamber 11*b* in only a predetermined section while utilizing the swing motion of the swing bush 8.

Further, since the communication passage for communication of the small space 16 with the compression chamber 11*b* is formed in the vane 7*b,* a simple construction permits the communication passage 17 to provide communication between the small space 16 and the compression chamber 11*b* in only a predetermined section while utilizing the projecting motion of the vane 7*b* into the cylinder chamber.

Further, since a plurality of small spaces 16 are provided so as to communicate with the compression chamber 11*b* in a plurality of predetermined sections, the difference between the pressure at the end of communication of each small space with the compression chamber 11*b* and the pressure at the beginning of the communication can be diminished and therefore the re-expansion loss can be further decreased.

The present invention may be practiced in various other forms without departing from the spirit or main features thereof. In other words, the preferred embodiments described above are mere illustrations and not limitations. The scope of the present invention are defined by the scope of claim and all of the modifications falling under the scope of claim are included in the present invention.

According to the present invention, as set forth above, it is possible to provide a rotary compressor capable of reducing a noise generated by a pressure fluctuation in the interior of the compression chamber and at the same time preventing the occurrence of a loss induced by re-expansion of the refrigerant which remains in the small space and a loss induced by return of the refrigerant to the suction chamber.

What is claimed is:

1. A rotary compressor comprising:

a cylinder which defines a cylinder chamber;

a piston disposed within said cylinder chamber; and a drive mechanism for driving said piston, said piston having a roller which performs a revolving motion within said cylinder chamber and a vane which, together with said roller, partitions the interior of said cylinder chamber into a suction chamber and a compression chamber, further comprising, a small space provided to communicate with said compression chamber in a predetermined section without coming into communication with said suction chamber, wherein said predetermined section is less than one revolution of said roller within said cylinder.

2. A rotary compressor comprising:

a cylinder which defines a cylinder chamber;

a piston disposed within said cylinder chamber; and a drive mechanism for driving said piston, said piston having a roller which performs a revolving motion within said cylinder chamber and a vane which, together with said roller, partitions the interior of said cylinder chamber into a suction chamber and a compression chamber, further comprising, a small space provided so as to communicate with said compression chamber in a predetermined section exclusive of a rotational angle of said roller corresponding to a minimum projection quantity of said vane into said cylinder chamber.

3. The rotary compressor according to claim 1 or claim 2, wherein said roller and said vane are formed integrally with each other, and said vane is supported by a swing bush so that it can swing, advance and retreat.

4. The rotary compressor according to claim 3, wherein a communication passage for communication of said small space with said compression chamber is formed in said swing bush.

5. A rotary compressor according to claim 4, wherein said communication passage for communication of said small space with said compression chamber is formed in said vane.

6. A rotary compressor according to claim 4, wherein said communication passage for communication of said small space with said compression chamber is constituted of a combination of a communication passage formed in said vane and a communication passage formed in said swing bush.

7. A rotary compressor according to claim 1 or claim 2, wherein said roller and said vane are formed separately from each other.

8. The rotary compressor according to claim 1, wherein the predetermined section in which said small space is brought into communication with said compression chamber is mainly a discharge stroke.

9. The rotary compressor according to claim 1, wherein the predetermined section in which said small space is brought into communication with said compression chamber is mainly the first half of a compression stroke.

10. The rotary compressor according to claim 1, wherein said small space is provided in the plural number, and the predetermined section in which said small space comes into communication with said compression chamber is also provided in the plural number.

11. The rotary compressor according to any of claims 10, wherein the predetermined section in such said small space is brought into communication with said compression chamber is mainly a discharge stroke.

12. The rotary compressor according to any of claims 10, wherein the predetermined section in which said small space is brought into communication with said compression chamber is mainly the first half of a compression stroke.

13. The rotary compressor according to any of claims 10, wherein said small space comprises a plurality of spaces, and the predetermined section in which said small space comes into communication with said compression chamber also comprises a plurality of sections.

14. A rotary compressor comprising:

a cylinder which defines a cylinder chamber;

a piston disposed within said cylinder chamber; and a drive mechanism for driving said piston, said piston having a roller which performs a revolving motion within said cylinder chamber and a vane, which together with said roller, partitions the interior of said cylinder chamber into a suction chamber and a compression chamber, said roller and said vane being formed integrally with each other, wherein a swing bush which supports said vane so as to absorb advance and retreat motions and swing motion of the vane is provided in said cylinder, and a plurality of small spaces adapted to communicate with said compression chamber are provided so as to communicate with the compression chamber in a plurality of predetermined sections.

15. A compressor communicated with a refrigerating cycle, comprising:

a closed vessel, at least one rotary cylinder provided in the closed vessel and forming a cylinder chamber therein, the rotary cylinder having a rotor revolving in the cylinder chamber, a vane advanced and retreated inward from the cylinder, the cylinder chamber having a suction recess passing through refrigerant from the refrigerating cycle and a discharge recess passing through compressed refrigerant, a small space provided adjacent to the discharge recess, and a communication passage connecting the small space with the cylinder chamber during a portion of the revolution of the rotor in the cylinder chamber, and disconnecting the small space from the cylinder chamber when the discharge recess and the suction recess are in communication.

16. The compressor according to the claim 15, wherein the communication passage connects the small space to the cylinder chamber in a compression strike of the compressor.

17. The compressor according to the claim 15, wherein the communication passage connects the small space to the cylinder chamber in a discharge stroke of the compressor.

18. The compressor according to the claim 15, further comprising end plates sandwiching the rotary cylinder.

19. The compressor according to the claim 18, wherein the small space is formed by the rotary cylinder and the end plates.

20. The compressor according to the claim 15, wherein the roller is integrated with the vane.

21. The compressor according to the claim 20, further comprising a swing bush connecting the vane and the cylinder, the vane being supported in the swing bush to as to be able to swing, advance and retreat.

22. The compressor according to the claim 21, wherein the communication passage connects the small space with the cylinder chamber when a swing angle of the vane is a predetermined angle relative to the radius of the cylinder chamber.

23. The compressor according to the claim 15, wherein the roller is separated from the vane.

24. The compressor according to the claim 23, wherein the communication passage disconnects the small space from the cylinder chamber when a projection quantity of the vane from the cylinder chamber is less than a predetermined quantity.

25. The compressor according to the claim 15, wherein the small space is provided in the vane.

26. The compressor according to the claim 25, further comprising a swing bush contacted to the vane and the cylinder, the vane being supported in the swing bush so as to be able to swing, advance and retreat.

27. The compressor according to claim 26, wherein the communication passage connects the small space with the cylinder chamber when a swing angle of the vane is a predetermined angle relative to the radius of the cylinder chamber.

28. A rotary compressor comprising:

a cylinder which defines a cylinder chamber;

a piston disposed within said cylinder chamber; and a drive mechanism for driving said piston, said piston having a roller which performs a revolving motion within said cylinder chamber and a vane which, together with said roller, partitions the interior of said cylinder chamber into a suction chamber and a compression chamber, wherein said roller and said vane are formed integrally with each other, and said vane is supported by a swing bush so that it can swing, advance and retreat, further comprising, a small space provided to communicate with said compression chamber in a predetermined section without coming, into communication with said suction chamber.

29. The rotary compressor according to claim 28, wherein a communication passage for communication of said small space with said compression chamber is formed in said swing bush.

30. The rotary compressor according to claim 29, wherein said communication passage for communication of said small space with said compression chamber is formed in said vane.

31. The rotary compressor according to claim 29, wherein said communication passage for communication of said small space with said compression chamber is constituted of a combination of a communication passage formed in said vane and a communication passage formed in said swing bush.

32. A compressor communicated with a refrigerating cycle, comprising:

a closed vessel, at least one rotary cylinder provided in the closed vessel and forming a cylinder chamber therein, the rotary cylinder having a rotor revolving in the cylinder chamber, a vane advanced and retreated inward from the cylinder, the cylinder chamber having a suction recess passing through refrigerant from the refrigerating cycle and a discharge recess passing through compressed refrigerant, a small space provided adjacent to the discharge recess, and means for connecting the small space with the cylinder chamber during a portion of the revolution of the rotor in the cylinder chamber, and disconnecting the small space from the cylinder chamber when the discharge recess and the suction recess are in communication.

* * * * *